US005630532A

United States Patent [19]

Herkenne et al.

[11] Patent Number: 5,630,532

[45] Date of Patent: May 20, 1997

[54] AIR PUMP FOR GENERATING EXCESS PRESSURE IN A FUEL TANK FOR LIQUID FUEL IN A PORTABLE HEATING DEVICE

[75] Inventors: Jacques Herkenne, Ettenhausen; Isidor Fritschi, Andelfingen, both of Switzerland

[73] Assignee: Sigg AG Haushaltgerate, Frauenfeld, Switzerland

[21] Appl. No.: 194,053

[22] Filed: Feb. 9, 1994

[30] Foreign Application Priority Data

Feb. 11, 1993 [CH] Switzerland ..... 00419/93-0

[51] Int. Cl.[6] ..... B65D 83/14

[52] U.S. Cl. ..... 222/396; 222/397; 222/400.8; 222/402

[58] Field of Search ..... 222/209, 396, 222/397, 400.8, 401, 402; 417/554

[56] References Cited

U.S. PATENT DOCUMENTS

| | | | |
|---|---|---|---|
| 2,354,265 | 7/1944 | Horvath | 417/554 |
| 3,955,720 | 5/1976 | Malone | 222/401 X |
| 4,492,320 | 1/1985 | Tada | 222/401 X |

*Primary Examiner*—Andres Kashnikow
*Assistant Examiner*—Joseph A. Kaufman
*Attorney, Agent, or Firm*—Cushman Darby & Cushman IP Group of Pillsbury Madison & Sutro LLP

[57] ABSTRACT

An air pump is configured as a reciprocating compressor. On a fuel tank, there is fitted a cylinder of the air pump, in which an axially displaceable piston rod, having a handle and a piston, is coaxially disposed. The piston divides the interior of the cylinder into two chambers. The lower one of these chambers, lying closer to the fuel tank, communicates with the fuel tank via a first one-way valve, which permits only the entry of air into the fuel tank. The upper one of these chambers, lying farther from the fuel tank, communicates unchecked with the atmosphere. The one-way sealing of the piston against the cylinder allows the passage of air past the piston only in the direction from the upper chamber to the lower chamber. The piston rod is provided with a coaxial duct and a second one-way valve which is opposed to the first. The two chambers are able to intercommunicate via the coaxial duct and the second one-way valve, which, from a predetermined pressure, allows air to escape to the atmosphere.

8 Claims, 8 Drawing Sheets

AIR PUMP FOR GENERATING EXCESS PRESSURE IN A FUEL TANK FOR LIQUID FUEL IN A PORTABLE HEATING DEVICE

BACKGROUND OF THE INVENTION

1. Field of the Invention

The invention relates to an air pump for generating excess pressure in a fuel tank for liquid fuel for running a portable heating device which is provided with a burner, to which the fuel can be fed from the fuel tank under pressure, the air pump being configured as a reciprocating compressor and comprising: a cylinder fitted on the fuel tank, a piston rod which is disposed coaxially in the cylinder and is axially displaceable, a handle which is designed to actuate the air pump and is supported on the piston rod at an end of the piston rod lying farther from the fuel tank, and a piston which is axially movable in the cylinder and is disposed so as to form a one-way seal and which is fitted at the other end of the piston rod lying closer to the fuel tank and divides the interior of the cylinder into two chambers, of which the one chamber lying closer to the fuel tank communicates with the fuel tank via a one-way valve which lets air enter into the fuel tank but prevents air and/or fuel from escaping from the fuel tank, and the other chamber lying farther from the fuel tank is able to communicate essentially unchecked with the atmosphere, whilst the one-way sealing of the piston against the cylinder permits the passage of air past the piston in the direction from the chamber lying farther from the fuel tank to the chamber lying closer to the fuel tank, but prevents it in the counter-direction.

The heating device provided with the air pump can be used in various variants. One variant thereof can be used for example, in rambling or camping, for cooking purposes (as the flame in a stove), another variant for example, also in rambling or camping, for illumination purposes (as a Welsbach light having an incandescent mantle), yet another variant for example, for craftsmen, for soldering or welding purposes, and yet other variants are also conceivable.

2. Description of the Related Art

An air pump of the stated type is known, for example, for a portable cooking or heating device, from Patent Specification AT-343318. In this known air pump, however, no measure is provided by which the user of the device could be prevented from developing too strong a pressure in the fuel tank by over-lengthy or too often repeated pumping and hence from placing himself and his surroundings, or herself and her surroundings, at risk.

SUMMARY OF THE INVENTION

The object of the invention is therefore to refine an air pump of the type defined in the introduction such that the pressure in the fuel pump cannot exceed a predetermined value.

In order to achieve this object, an air pump of the type defined in the introduction is characterized in that the piston rod is provided with a coaxial duct and with a second one-way valve controlling the passage of air through this duct, the two chambers being able to intercommunicate via the duct and the second one-way valve, and, from a predetermined pressure, the second one-way valve allowing air to escape from the chamber lying closer to the fuel tank in the direction of the atmosphere, but preventing it from escaping in the counter-direction.

The second one-way valve provided according to the invention can herein be disposed on the piston rod essentially at an end of the duct lying farther from the fuel tank, the handle preferably being able to be supported on a housing of the second one-way valve and, via this housing, at the end of the piston rod lying farther from the fuel tank. The second one-way valve provided according to the invention can also however be disposed on the piston rod essentially in the duct or indeed essentially at an end of the duct lying closer to the fuel tank.

The fact that, from a predetermined pressure, the second one-way valve permits the passage of air from the fuel tank to the atmosphere prevents the user of the device from developing in the fuel tank a pressure exceeding the pressure limited by the one-way valve even if he or she subjects it to lengthy or often repeated pumping.

As an advantageous consequence thereof, the fuel is able to make its way from the fuel tank to the atmosphere via the leakage in the air pump, which must always be expected of course, only under limited pressure, so that the leakage itself also remains within limits, thereby reducing the risk to the environment.

The limitation of the leakage gives rise, in turn, to a new advantage of the air pump according to the invention, namely to the possibility, when the device is in the rest state in which the piston rod is essentially in its position fully retracted into the cylinder, of enclosing the air pump under a seal-forming cap. As a result of this cap, the escape of fuel from the device in its rest state is virtually prevented. It will be clearly apparent that a user, for example a rambler, will be more likely to be happy with his or her petrol stove if he or she can be sure that no petrol and not even the smell of petrol from the stove will get into his or her rucksack.

For the sealing of the air pump, the handle is preferably configured as a cap which is coaxial to the cylinder and covers the end of the piston rod lying farther from the fuel tank. A sealing surface of this cap is herein supported, via a sealing ring, on a corresponding sealing surface either of the cylinder or, in another design variant, of a receiving part disposed on the cylinder, whenever the piston rod is essentially in its position fully retracted into the cylinder. In this latter design variant, it is advantageous for a fastening to be able to be formed between the receiving part and the cap. For this purpose, there is provided on the receiving part a sleeve which is disposed coaxially to the cylinder and forms, in interaction with the cap, a fastening which is designed and configured to secure the piston rod, detachably, essentially in its position fully retracted into the cylinder and to ensure, at the same time, that the sealing surfaces are pressed against the intermediate sealing ring such that they form a seal. Preferably, the cap is supported rotatably on the piston rod and the fastening is configured essentially as a screw fastening or bayonet fastening, respective sections of the sleeve and of the cap, which sections lie opposite each other when the piston rod is secured, being provided with cams and/or ramps, for the creation of this fastening, which mutually correspond and can be brought into mutual engagement for the closing of the fastening.

BRIEF DESCRIPTION OF THE DRAWINGS

An illustrative embodiment of the invention is described in greater detail below with reference to the drawings, in which.

DESCRIPTION OF THE PREFERRED EMBODIMENTS

Figure 1:
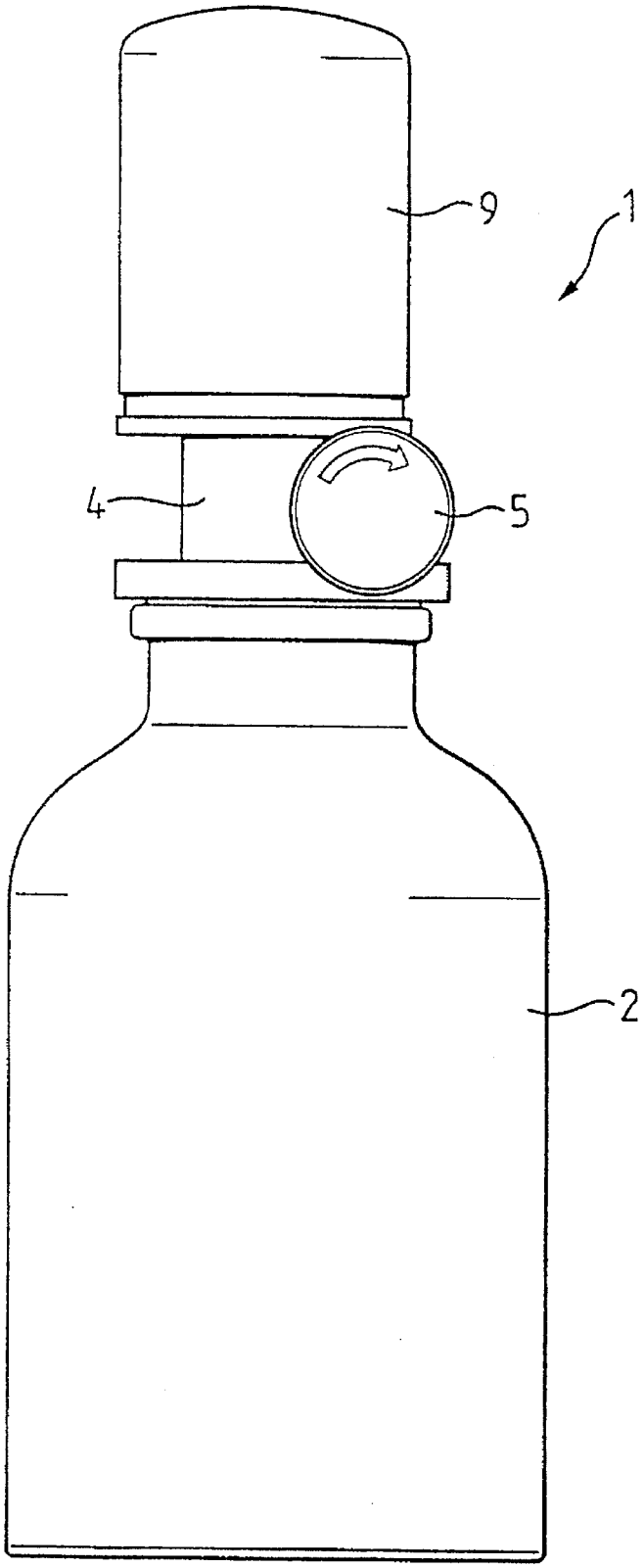
FIG. 1 shows a front view of a fuel tank with an air pump according to the invention fitted on it, in locked setting.
Figure 2:
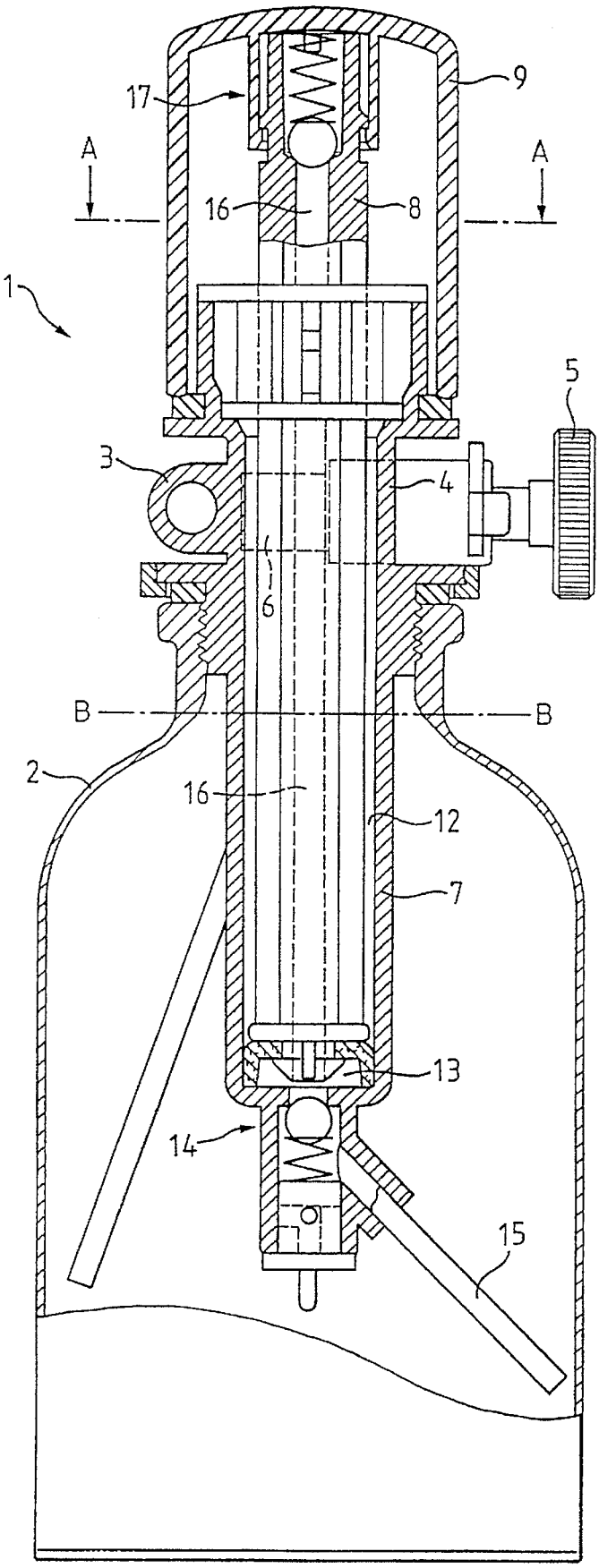
FIG. 2 shows a side view of the air pump according to the invention fitted on the fuel tank, according to FIG. 1, in axial section.
Figure 3:
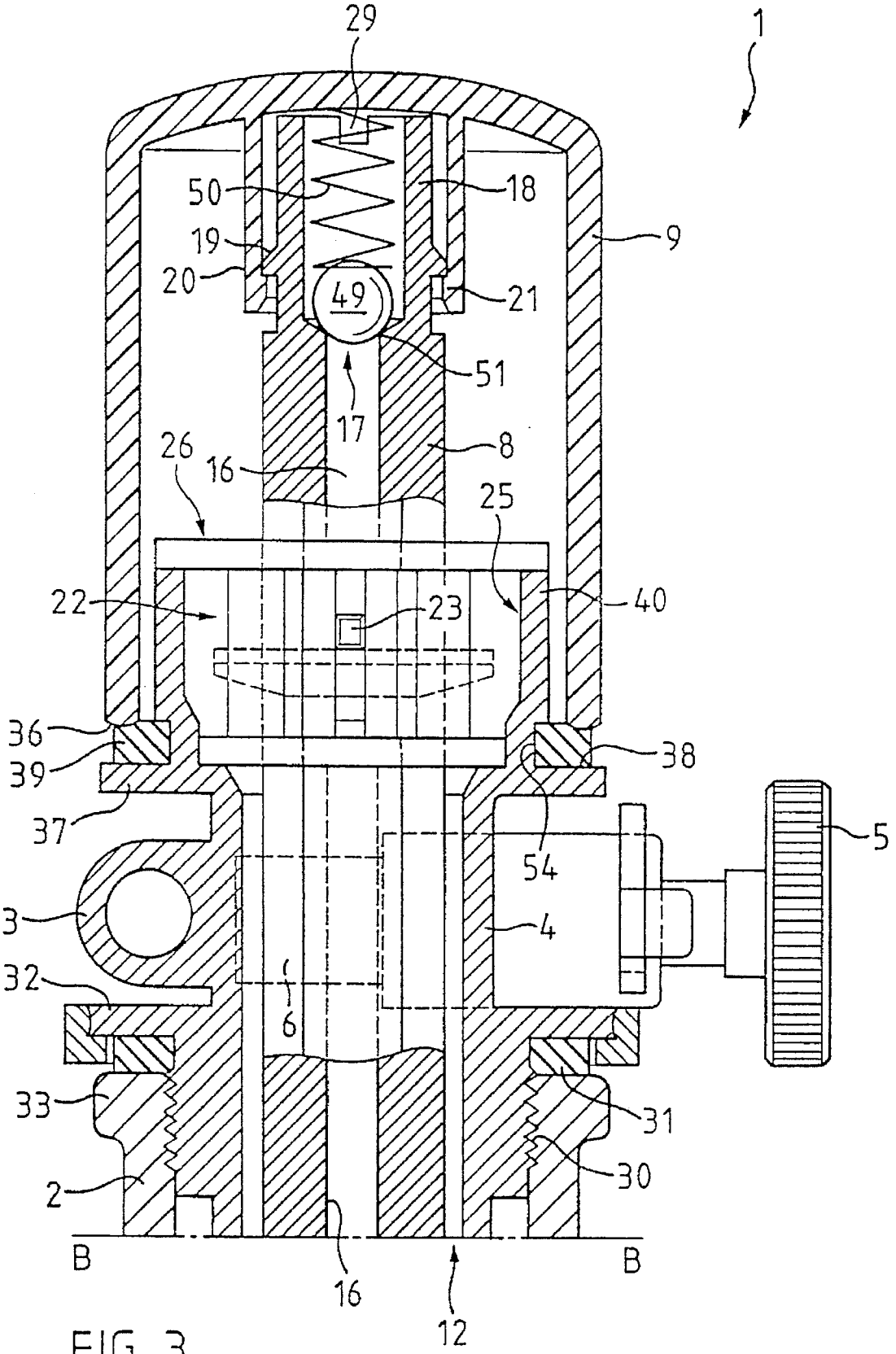
FIG. 3 shows an enlarged side view of the upper half of the object represented in FIG. 2 above the dividing line B—B of FIG. 2, in the same axial section as in FIG. 2.
Figure 4:
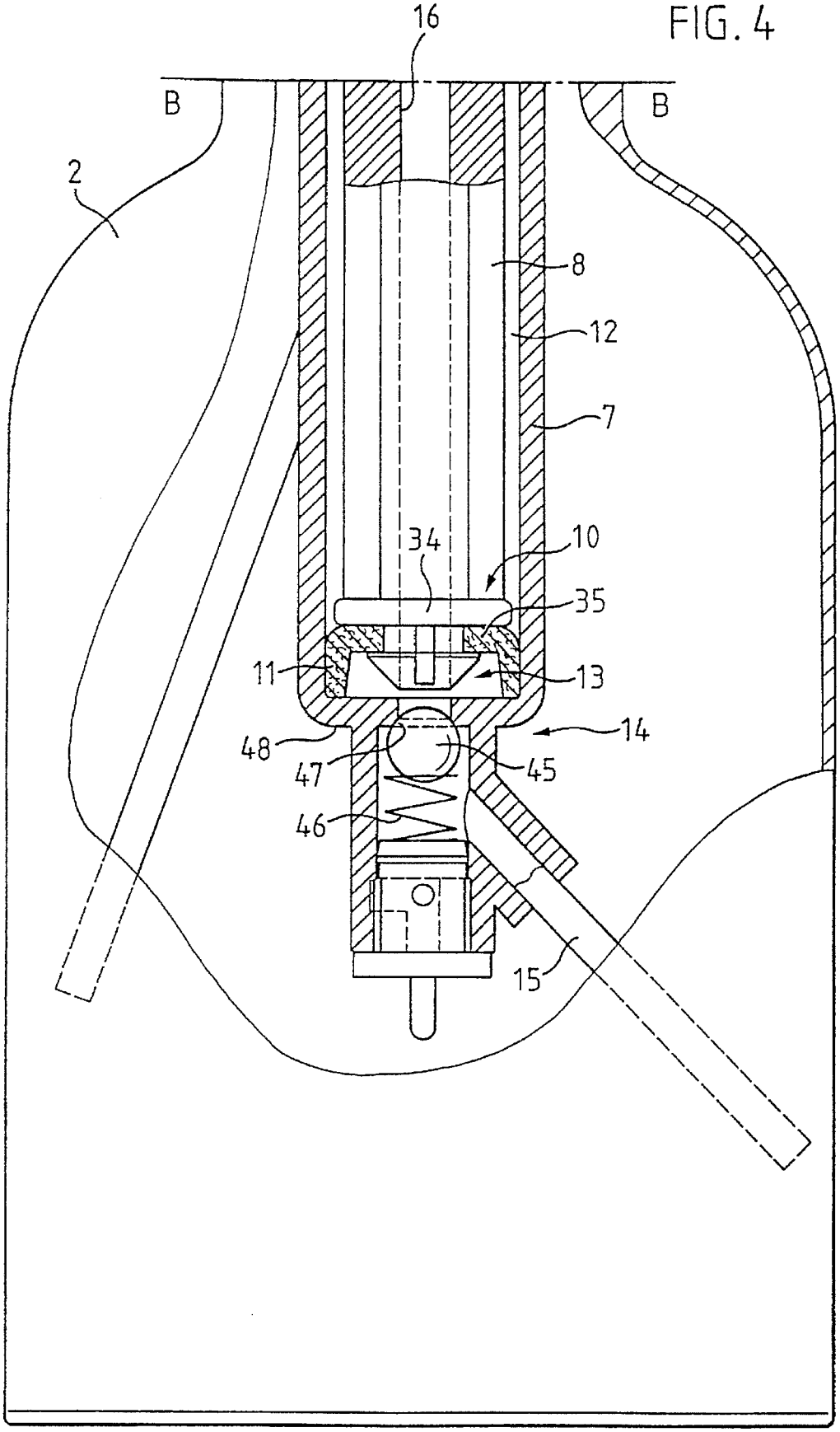
FIG. 4 shows an enlarged side view of the lower half of the object represented in FIG. 2 below the dividing line B—B of FIG. 2, in the same axial section as in FIG. 2.
Figure 5:
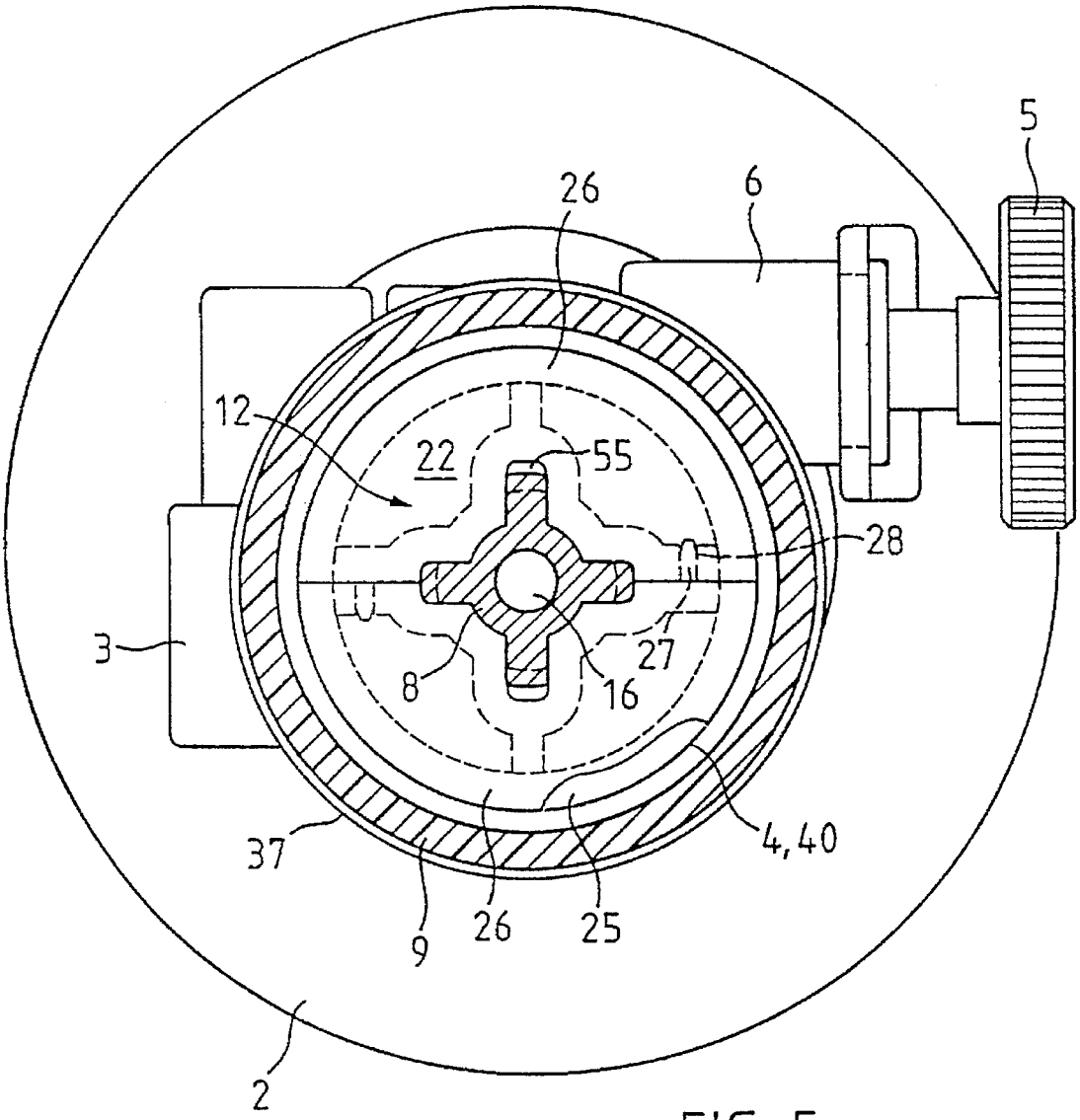
FIG. 5 shows a cross-section in the plane of the sectional line A—A of FIG. 2.
Figure 6:
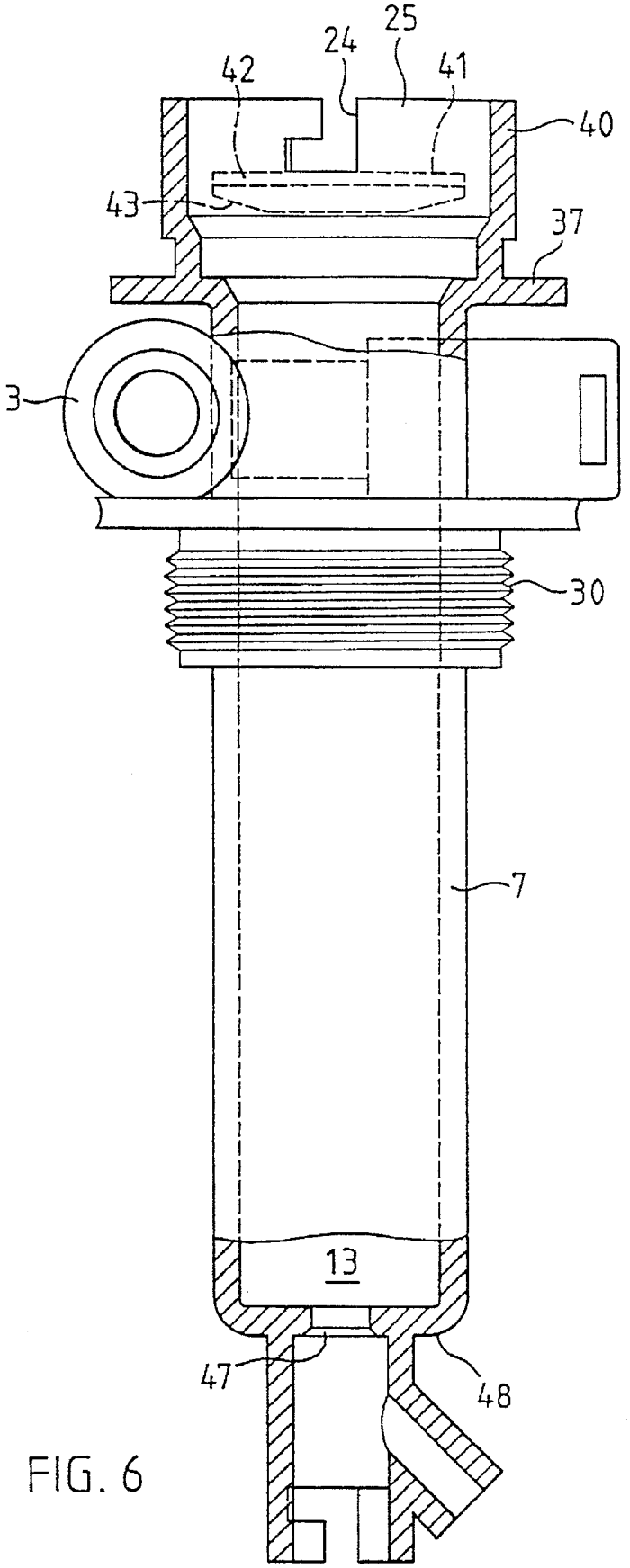
FIG. 6 shows a cylinder part of the air pump according to the invention, in the same side view as in FIGS. 2–4 but only partially in section.
Figure 7:
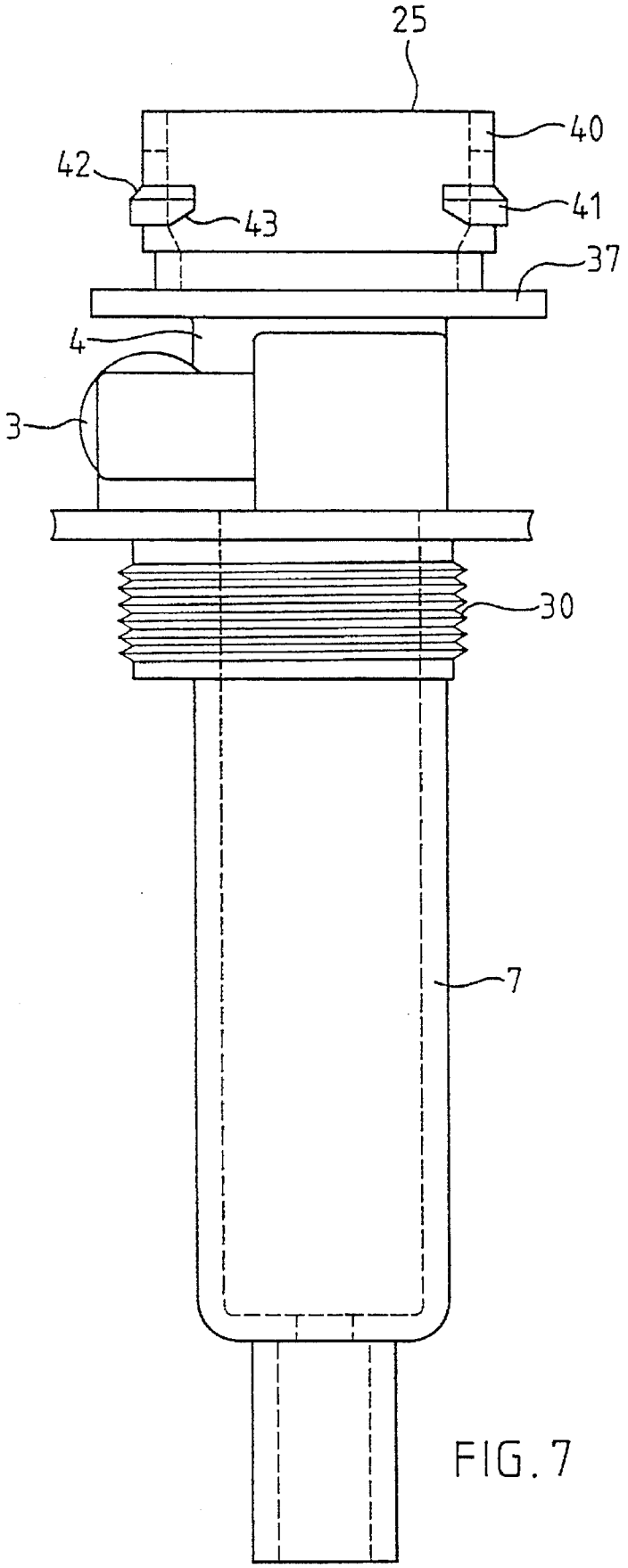
FIG. 7 shows the cylinder part of FIG. 6 in rear view.
Figure 8:
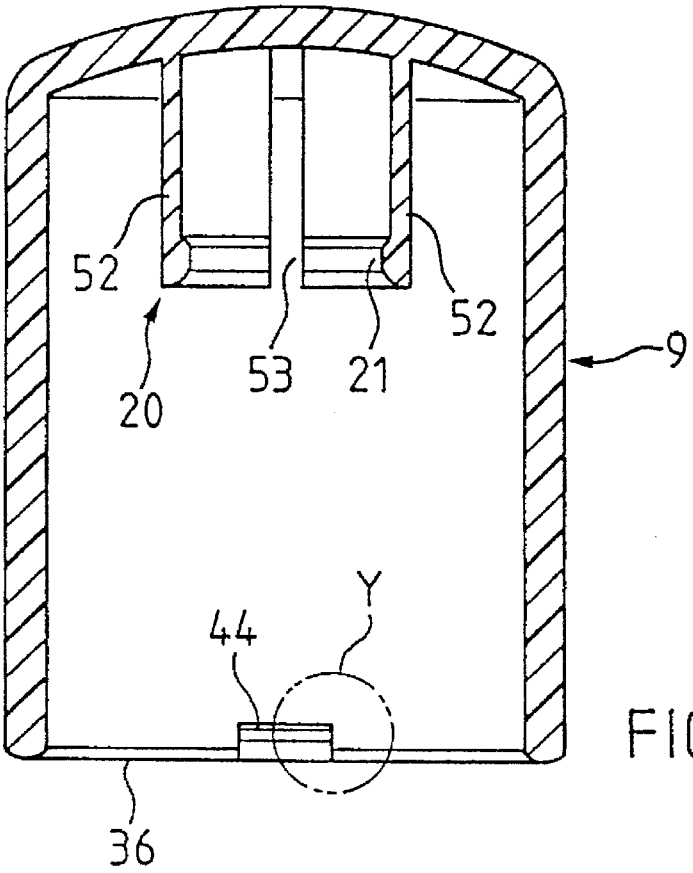
FIG. 8 shows a cap of the air pump according to the invention, in an axial section.
Figure 9:
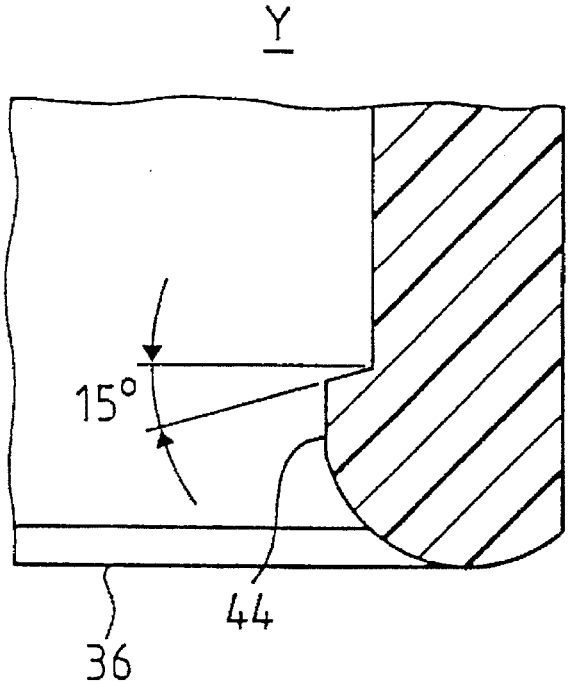
FIG. 9 shows, on an enlarged scale, a cam disposed in the region designated by Y of the cap of FIG. 8, in the axial section of the cap perpendicular to the sectional plane of FIG. 8.

In FIGS. 1, 2 and 3, an air pump 1 according to the invention is represented fitted and fastened on a fuel tank 2.

The fuel tank 2 is designed to contain liquid fuel for running a portable device (not represented), for example a petrol stove. This device is provided with a burner (not represented), to which the fuel can be fed under pressure from the fuel tank 2 via a corresponding hose (not represented). At a connection point 3 which is disposed on a casing 4 of the air pump 1, this hose can be connected to the fuel tank 2, for example by means of a pipe socket which can be screwed in to form a seal, and the supply of the fuel from the fuel tank 2 to the burner can be adjusted using a knurled regulating wheel 5 of a metering device 6 likewise disposed on the casing 4 of the air pump 1.

The fastening and sealing of the air pump 1 onto the fuel tank 2 is effected in a manner known per se, for example using mutually corresponding threaded parts 30 of the air pump 1 and of the fuel tank 2, a seal 31 between a flange 32 disposed on the casing 4 of the air pump 1 and a flange 33 disposed on the fuel tank 2 being compressed whenever the fuel tank 2 is screwed onto the air pump 1.

The air pump 1 is designed to generate an excess pressure in the fuel tank 2 in order to enable the fuel to be fed under pressure from the fuel tank 2 to the burner. For this purpose, the air pump 1, in similar manner, for instance, to a bicycle pump, is configured as a reciprocating compressor and is provided essentially with the component parts described below. A cylinder 7 is disposed on the casing 4 or configured as part of it, such that the cylinder 7 is fitted, by means of the casing 4, on the fuel tank 2 and intrudes into it. In the cylinder 7 there is disposed a piston rod 8, coaxially thereto and displaceable therein in its axial longitudinal direction. At its upper end lying farther from the fuel tank 2, this piston rod 8 is provided with a handle designed to actuate the air pump, which handle is configured, in the represented illustrative embodiment of the invention, as a cap 9 coaxial to the cylinder 7. At the other, lower end of the piston rod 8, lying closer to the fuel tank 2, there is supported on the said piston rod a piston 10, which, on the same principle as in a bicycle pump, is disposed such that it can be moved axially in the cylinder 7 and forms a one-way seal. The piston 10 essentially comprises, for this purpose, a disc 34 and an approximately U-shaped leather seal 35, supported on it, having a lip 11, which lip seals the piston 10 against the cylinder 7. The piston 10 divides the interior of the cylinder 7 into two chambers 12 and 13. The lip 11 or the thereby realized one-way sealing of the piston 10 against the cylinder 7 allows the passage of air past the piston 10 in the direction from the chamber 12 lying farther from the fuel tank 2 to the chamber 13 lying closer to the fuel tank, whereas in the counter-direction the lip 11 or the one-way sealing of the piston 10 against the cylinder 7 which is brought about by this lip prevents the passage of air past the piston 10.

Furthermore, on the same principle as in a bicycle pump, the chamber 13 lying closer to the fuel tank 2 communicates with the said fuel tank via a one-way valve 14, which lets air enter into the fuel tank 2 via a pipe 15, but prevents air and/or fuel from escaping from the fuel tank 2. For its part, the chamber 12 lying farther from the fuel tank 2 communicates essentially unchecked with the atmosphere in the space below the cap 9 and, forwards from there, with the free atmosphere, except for when the cap 9 is in a locked position on the casing 4, as is explained further below.

In the represented illustrative embodiment, the one-way valve 14 is configured as a ball valve and essentially comprises a ball 45, which is pressed by a helical spring 46 onto a seat 47 provided at a lower end 48, lying closer to the fuel tank 2, of the cylinder 7. The hardness of the helical spring 46 is dimensioned such that the force of the contact pressure of the ball 45 upon the seat 47 lets the air enter into the fuel tank 2 as soon as an excess pressure of around 10 kPa (0.1 bar), for example, arises in the chamber 13.

In order to optimize its stiffness, the piston rod 8 exhibits an essentially cruciform cross-section and is provided with a coaxial duct 16. A second one-way valve 17 controls the passage of air through this duct 16. In the represented illustrative embodiment of the invention, this second one-way valve 17 is fitted on the piston rod 8 and is disposed essentially at the end of the duct 16 lying farther from the fuel tank 2. A housing 18 of the one-way valve 17 is herein configured in one piece with the piston rod 8. In the represented illustrative embodiment, the one-way valve 17 is likewise configured as a ball valve and essentially comprises a ball 49, which is pressed by a helical spring 50 onto a seat 51 provided on the housing 18. The hardness of the helical spring 50 is dimensioned such that the force of the contact pressure of the ball 49 upon the seat 51 lets the air escape from the duct 16 as soon as an excess pressure of around 50 kPa (0.5 bar), for example, arises in the chamber 13. It should be understood, however, that other illustrative embodiments of the one-way valves 14 and 17 having the same action can also exercise the same function.

The cap 9, which acts as a handle for actuating the air pump, is supported and fastened on this housing 18 of the one-way valve 17 and thereby also on the end of the piston rod 8 lying farther from the fuel tank 2. For this purpose, the housing 18 of the one-way valve 17 is provided on its cylindrical outer side with a coaxially skirting rib 19, projecting radially outwards, and the cap 9 is provided with a sleeve 20 disposed coaxially to the cylinder. This sleeve 20 is configured, in the represented illustrative embodiment, in two parts, having two sleeve parts 52 between which there is provided a diametrical slot 53. Moreover, the sleeve 20 is provided on its cylindrical inner side with a coaxially skirting rib 21, projecting radially inwards. The axial length of the housing 18 and of the sleeve 20 and the position of the ribs 19 and 21 in the axial direction are dimensioned such that the housing 18 and the rib 19, in interaction with the sleeve 20 and the rib 21, form a fastening, which acts essentially as a snap fastening. The two sleeve parts 52 are formed onto the cap 9 in one piece and together form, disregarding the diametrical slot 53, a sleeve 20 which is configured essentially coaxially to the cap 9 and is formed onto it. In choosing the synthetic material for the sleeve 20 or the cap 9, consideration is given to the fact that this synthetic material should be sufficiently elastic to allow the rib 21 of the sleeve 20, when the cap 9 is placed or pressed onto the piston rod 8, to slide over the rib 19 of the housing 18 and snap in behind it, whereupon the sleeve parts 52, thanks to the diametrical slot 53, are temporarily bent radially outwards. Finally, in the dimensioning both of the outer diameter of the rib 19 of the housing 18 relative to the inner diameter of the sleeve 20 and of the relative position of the ribs 19 and 21 in the axial direction, a play of 0.1 mm, for example, is provided, which allows the cap 9 to rotate relative to the housing 18 of the one-way valve 17 and hence also to the casing 4 of the air pump 1.

Once the cap 9, as indicated, has been coaxially attached to the piston rod 8 and remains secured, the user is able, using the cap 9, both to push in and pull out the piston rod 8 relative to the cylinder 7. The piston rod 8 can be pushed in until it is essentially in its position fully retracted into the cylinder 7. When being pulled out, on the other hand, the piston rod 8 must be prevented from being inadvertently fully removed from the cylinder 7. For this purpose, at the upper end of the cylinder 7 lying farther from the fuel tank 2 there is disposed a guide 22 of the piston rod 8, which guide allows the piston rod 8 to slide through, but does not allow the piston 10 located at the end of the piston rod 8 to pass through. This guide 22 exhibits a recess 55, corresponding to the cross-section of the piston rod 8, of essentially cruciform cross-section, in which recess the piston rod 8 can slide in its axial longitudinal direction. The guide 22 is provided with a pair of cams 23 essentially diametrically opposite each other, which can be introduced into corresponding, approximately L-shaped recesses 24 in an essentially cylindrical receiving part 25 to form, in interaction with it, when the guide 22 is inserted into the receiving part 25, a bayonet fastening. In order to make it easier to fit, the guide 22 is configured moreover in two parts, having two approximately semi-cylindrical guide parts 26. These guide parts 26 are held together using approximately tangentially directed pins 27 and corresponding recesses 28 in the axial direction of the guide 22. When the guide 22 is then inserted in the receiving part 25, it is enclasped thereby and secured therein by the bayonet fastening, so that it can also no longer fall apart into its two guide parts 26.

The chamber 12 of the cylinder 7 lying farther from the fuel tank 2 communicates, via a play of, for example, and depending upon the spot, 0.1 to 0.3 mm between the piston rod 8 and the guide 22 or guide parts 26, essentially unchecked with the atmosphere in the space below the cap 9 and, forwards from them, with the free atmosphere.

In order also to enable the chamber 13 of the cylinder 7 lying closer to the fuel tank 2 to communicate via the duct 16, when the one-way valve 17 is open, essentially unchecked with the atmosphere in the space below the cap 9 and, forwards from there, with the free atmosphere, the housing 18 of the one-way valve 17 is provided, at its upper end adjacent to the cap 9, with a recess 29 or a pair of such recesses essentially diametrically opposite each other, via which the air streaming out at the one-way valve 17 is able to make its way to the space between the inner side of the sleeve 20 and the housing 18. From this space between the sleeve 20 and the housing 18, the air is then able to escape via the aforementioned slot 53 between the sleeve parts 52 and hence make its way forwards to the space between the outer side of the sleeve 20 and the inner side of the cap 9.

From the space between the outer side of the sleeve 20 and the inner side of the cap 9, the air is able to make its way forwards to the free atmosphere, except when the cap 9 is in the locked position on the casing 4, as will now be explained. The cap 9 coaxial to the cylinder 7 covers, in an approximate bell shape, the upper end of the piston rod 8 lying farther from the fuel tank 2 and exhibits, essentially on its lower periphery lying closer to the fuel tank 2, a coaxial sealing surface 36. On the casing 4 or on the receiving part 25 of the air pump 1 there is disposed a coaxial flange 37, which exhibits a sealing surface 38 for supporting a washer-shaped sealing ring 39 and, adjoining this sealing surface 38, an annular groove 54 for receiving and holding the sealing ring 39. The width of the sealing ring 39 is dimensioned in the axially direction such that the sealing ring 39 is compressed between the sealing surfaces 36 and 38 and seals these one to the other whenever the piston rod 8 is essentially in its position fully retracted into the cylinder 7.

Naturally, other and nevertheless equivalent design variants are possible. For example, the sealing surface disposed on the cylinder can be configured directly as a cylindrical outer surface of the receiving part 25, for example, or of an upper region of the cylinder 7, the sealing in this case being effected, using an O-ring seal, directly between this cylindrical outer surface and the cylindrical inner surface of the cap 9, whereupon the sealing ring is now compressed in the radial direction.

The cap 9 is herein acted upon, on the one hand, by the reaction of the compressed sealing ring 39 when this is compressed in the axial direction, on the other hand by the pressure, under the cap 9, which pressure possibly develops as the result of a leakage in the air pump. In order to secure the cap 9 against the corresponding forces and hence to ensure the sealing by pressing the sealing surfaces 36 and 38 against the intermediate sealing ring 39, as well as to hold the piston rod 8 essentially in its position fully retracted into the cylinder 7, a fastening is provided for fastening the cap 9 detachably to the receiving part 25 of the cylinder 7. To this end, there is provided on the receiving part 25 a coaxial sleeve 40, which is provided with a pair of cams 41 essentially diametrically opposite each other. Each of these cams 41 is provided, on its upper part, with an oblique section or a ramp 42 and, on its lateral end regions, respectively with an oblique section or a ramp 43, and each of these cams 41 is configured moreover, in its lower part, as a projection jutting approximately rectangularly outwards. For its part, the cap 9, in the proximity of its lower periphery lying closer to the fuel tank 2 or in the proximity of the sealing surface 36, is provided on its inner side with a pair of cams 44 essentially diametrically opposite each other, each of which, on the essentially cylindrical inner side of the cap 9, is directed radially inwards and, in its upper part, is configured as a projection jutting approximately rectangularly inwards.

This arrangement and configuration of the cams 41 and 44 give rise to a situation wherein, when the piston rod 8 is essentially in its position fully retracted into the cylinder 7, a respective cam 44 of the cap 9, in a corresponding first rotational position of the cap 9 relative to the sleeve 40, engages with its upper part behind a lower part of a cam 41 of the sleeve 40 and thereby locks the cap 9 on the sleeve 40, i.e. on the casing 4. The length of the cams 41 and 44 on the periphery of the sleeve 40 and the cap 9 respectively is dimensioned such that gap exists in each case between the cams, which gap, in a corresponding second rotational position of the cap 9 relative to the sleeve 40, releases the mutual engagement of the cams and hence allows the cap 9 to be pulled away from the sleeve 40, i.e. the piston rod 8 to be pulled out of the cylinder 7. The effect of this is that the first rotational position of the cap 9 is twisted by 90° relative to the second rotational position of the cap 9. Naturally, instead of in each case two cams 41 and 44 respectively, three, four or six cams can in each case be provided and the first rotational position of the cap 9 is in this case twisted by 60°, 45° or 30° relative to the second rotational position of the cap 9. A fastening is thereby formed, which essentially constitutes a bayonet fastening.

In order to close this fastening, the cap 9 is firstly brought into its above-mentioned second rotational position in order to prevent the cams 41 and 44 entering into mutual engagement. The piston rod 8 is then brought essentially into its position fully retracted into the cylinder 7. Following this, the cap 9 is rotated in order to bring the cams 41 and 44 into mutual engagement and thereby secure the piston rod 8. Upon the mutual engagement of the cams 41 and 44, it is helpful for the cams 41 to be respectively provided, on their lateral end regions, with an oblique section or ramp 43, since this ramp 43 allows the user to rotate the cap 9 even when the piston rod 8 has not been retracted fully into the cylinder 7, in which case the rotation of the cap 9 acts as a screwing-in.

The closing of the fastening can be achieved however in yet another way, since the cams 41 and 44 can also be brought into mutual engagement in a different way. In this case, the cap 9 is firstly brought into its above-mentioned first rotational position, so that the cams 41 and 44 come to lie one above the other whenever the piston rod 8 is pressed into the cylinder 7. When the cams 41 and 44, lying one above the other, then enter into engagement when pressed in, the cap 9 can be pressed in with somewhat more force, whereupon its previously mentioned elasticity and the respective ramp 42 on the upper part of the cams 41 of the sleeve 40 allow the cams 44 of the cap 9, as in the case of a snap fastening, to rise above the cams 41 of the sleeve 40 and subsequently to engage behind the latter, i.e. to snap in behind the cams 41 of the sleeve 40.

In principle, the fastening can also be otherwise configured, for example as a screw fastening having respective groups of cams and/or ramps, on the one hand on the sleeve 40 and on the other hand on the cap 9, which cams and/or ramps lie opposite each other when the piston rod 8 is secured. The cams and/or ramps, at least of one of these groups, are in this case directed obliquely to the axis in order to bring about, with the cams and/or ramps of the other group, the desired thread effect whenever they are brought into mutual engagement for the closing of the fastener.

It is also possible to dispose the second one-way valve fitted on the piston rod 8 essentially in the duct or even at the other end of the duct 16 lying closer to the fuel tank 2, instead of disposing it, as in the represented illustrative embodiment, essentially at the end of the duct 16 lying farther from the fuel tank 2. In these cases, the handle or the cap 9 is then rotatably supported directly on the piston rod 8.

We claim:

1. An air pump for generating excess pressure in a fuel tank for liquid fuel for running a portable heating device which is provided with a burner, to which the fuel can be fed from the fuel tank under pressure, the air pump being configured as a reciprocating compressor and comprising:

a cylinder fitted on the fuel tank;

a piston rod which is disposed coaxially in the cylinder and is axially displaceable;

a handle which is designed to actuate the air pump and is supported on the piston rod at an end of the piston rod lying farther from the fuel tank;

a piston which is axially movable in the cylinder and is disposed so as to form a one-way seal and which is fitted at the other end of the piston rod lying closer to the fuel tank and divides the interior of the cylinder into two chambers, of which one said chamber lying closer to the fuel tank communicates with the fuel tank via a first one-way valve which lets air enter into the fuel tank but prevents air and fuel from escaping from the fuel tank, and another said chamber lying farther from the fuel tank is able to communicate essentially unchecked with the atmosphere;

one-way sealing of the piston against the cylinder permitting passage of air past the piston in a first direction from the chamber lying farther from the fuel tank to the chamber lying closer to the fuel tank, but prevents passage of air past the piston in a second direction which is counter to said first direction;

said piston rod being provided with a coaxial duct and with a second one-way valve controlling the passage of air through this duct;

the two chambers being able to intercommunicate via the duct and the second one-way valve;

said first and second one-way valves each having a direction of one-way flow, said directions of one-way flow being opposed to one another, and from a predetermined pressure, the second one-way valve allowing air to escape from said predetermined pressure, from the chamber lying closer to the fuel tank in the direction of the atmosphere, but preventing air from escaping in a counter-direction.

2. The air pump according to claim 1, wherein the second one-way valve is disposed on the piston rod essentially at an end of the duct lying farther from the fuel tank.

3. The air pump according to claim 2, wherein the handle is supported on a housing of the second one-way valve and, via this housing, at the end of the piston rod lying farther from the fuel tank.

4. The air pump according to claim 1, wherein the second one-way valve is disposed on the piston rod essentially in the duct.

5. The air pump according to claim 1, wherein the handle is configured as a cap which is coaxial to the cylinder and covers the end of the piston rod lying farther from the fuel tank, and in that a sealing surface of this cap is supported, via a sealing ring, on a corresponding sealing surface of the cylinder, whenever the piston rod is essentially in its position fully retracted into the cylinder.

6. The air pump according to claim 1, wherein the handle is configured as a cap which is coaxial to the cylinder and covers the end of the piston rod lying farther from the fuel tank, and in that a sealing surface of this cap is supported, via a sealing ring, on a corresponding sealing surface of a receiving part disposed on the cylinder, whenever the piston rod is essentially in its position fully retracted into the cylinder.

7. The air pump according to claim 6, wherein there is provided on the receiving part a sleeve which is disposed coaxially to the cylinder and forms, in interaction with the cap, a fastening which is designed and configured to secure the piston rod, detachably, essentially in its position fully retracted into the cylinder and to ensure, at the same time, that the said sealing surfaces are pressed against the intermediate sealing ring such that they form a seal.

8. The air pump according to claim 7, wherein the cap is supported rotatably on the piston rod and the fastening is configured essentially as one of a screw fastening and a bayonet fastening, and in that respective sections of the sleeve and of the cap, which sections lie opposite each other when the piston rod is secured, are provided with cams for the creation of this fastening, which mutually correspond and can be brought into mutual engagement for the closing of the fastening.

* * * * *